US006099366A

United States Patent [19]

Shinchi

[11] Patent Number: 6,099,366

[45] Date of Patent: Aug. 8, 2000

[54] TERMINAL AND CONNECTION STRUCTURE BETWEEN TERMINAL AND WIRE

[75] Inventor: Akira Shinchi, Shizuoka-ken, Japan

[73] Assignee: Yazaki Corporation, Tokyo, Japan

[21] Appl. No.: 09/086,564

[22] Filed: May 29, 1998

[30] Foreign Application Priority Data

May 30, 1997 [JP] Japan ..... 9-142486

[51] Int. Cl.[7] ..... H01R 4/10

[52] U.S. Cl. ..... 439/877; 439/594

[58] Field of Search ..... 439/877, 586, 439/587, 588, 589, 593, 594, 601, 577

[56] References Cited

U.S. PATENT DOCUMENTS

| | | | |
|---|---|---|---|
| 2,551,934 | 5/1951 | Flood et al. | 439/601 |
| 3,691,509 | 9/1972 | Krol | 439/587 |
| 5,928,033 | 7/1999 | Kato et al. | 439/587 |

FOREIGN PATENT DOCUMENTS

| | | |
|---|---|---|
| 4-61777 | 2/1992 | Japan . |
| 1 268 770 | 3/1972 | United Kingdom . |
| 2 321 797 | 5/1998 | United Kingdom . |

OTHER PUBLICATIONS

UK Search Report Aug. 28, 1998.

*Primary Examiner*—Lincoln Donovan
*Attorney, Agent, or Firm*—Finnegan, Henderson, Farabow, Garrett & Dunner, L.L.P.

[57] ABSTRACT

A terminal has a lower plate and an upper plate and is accommodated in a groove portion of a connector housing. A covered wire is inserted between the lower plate and upper plate. When a cover is mounted over the groove portion, a protrusion of the cover presses the terminal so that the upper and lower plates are closed. By ultrasonic vibration, a covering portion of the covered wire is melted and removed and cores are pinched between the upper and lower plates and held. An engaging pawl is engaged with the upper plate thereby the pinching condition of the cores being held. As a result, even if contacting load is reduced due to a change of the temperature or like reason, the contact condition between the covered wire and the cores are securely maintained.

7 Claims, 5 Drawing Sheets

TERMINAL AND CONNECTION STRUCTURE BETWEEN TERMINAL AND WIRE

BACKGROUND OF THE INVENTION

This invention relates to a connection structure for connecting a wire and a terminal with each other by ultrasonic vibration.

Japanese Patent Application Publication No. H7-70345 has disclosed a structure in which a covering portion of a covered wire is melted and removed by applying ultrasonic vibration so as to conductively connect cores of the covered wire to a terminal.

In a conventional connector as shown in FIGS. 1A, 1B and 2, first member 1 and second member 2 formed of resin oppose each other.

On a top face of the first member 1 are formed groove portions 3 and small concave portions 4. A terminal 5 is inserted in the groove portion 3 of the first member 1. On the terminal 5 is placed a covered wire 6. The covered wire 6 is placed on the terminal 5 in such a condition that a plurality of its cores are covered with a covering portion made of resin.

On a bottom face are formed protrusions 7 engaging with each of the groove portions 3 of the first member 1 and small convex portions 8 fitting into each of the concave portions 4 of the groove portions 3.

As shown in FIG. 2, the terminal 5 and covered wire 6 are inserted into the groove portion 3 of the first member 1 and then the protrusions 7 of the second member 2 are engaged with the groove portions 3 of the first member 1. As a result, the terminal 5 and covered wire 6 are pressed by the second member 2 and first member 1. At this time, the terminal 5 and covered wire 6 are partly bent at the engagement portions between the concave portion 4 and the convex portion 8, thereby preventing slippage thereof.

Then, with the terminal 5 and the covered wire 6 being pinched by the first member 1 and the second member 2, ultrasonic vibration is applied using a horn while a pressure is being applied thereto. By heat generated during the ultrasonic vibration, the covering portion of the covered wire 6 is melted and removed, so that the inside cores are exposed. Then, the exposed cores are conductively connected to the terminal 5. At the same time when this conductive connection is achieved, the first member 1 and the second member 2 are integrated so that a connector accommodating the terminals 5 and wires is produced.

FIG. 3 shows a structure for producing a multi-pole connector. On the first member 1 are formed a plurality of the groove portions 3. On the second member 2 are formed a plurality of protrusions 7 corresponding to the groove portions 3. After the terminal is accommodated in each of the groove portions 3, the covered wire is placed on each terminal. The covered wires are pinched by the first member 1 and second member 2, and by applying ultrasonic vibration while a pressure being also applied thereto, the connector is produced.

However, after the ultrasonic vibration is finished, the resin made first member 1 and second member 2 shrink due to a change of the temperature. Due to this shrinkage, contacting load making the terminal 5 and cores into contact with each other is reduced. Thus, there may be produced a contact failure between the terminal 5 and cores so that electrical connecting reliability may be reduced. Further, the terminal 5 and covered wire 6 are easy to be deviated when the connector is made or separated, so that a contact failure between the terminal 5 and cores likely occurs due to the deviation.

SUMMARY OF THE INVENTION

Accordingly, the present invention has been proposed to solve the above problem and it is therefore an object of the present invention to provide a terminal and a connection structure between the terminal and wire wherein a contact between the terminal and covered wire is secured so that an electrical connecting reliability can be improved.

To achieve the above object, according to a first aspect of the present invention, there is provided a terminal which is to be in a conductive contact with cores of a covered wire, the covered wire having the cores and a covering portion made of resin for covering the cores, the covering portion being melted and removed when the covered wire is subjected to ultrasonic vibration while the covered wire is pressed against the terminal, so that the terminal is in a conductive contact with the cores, the terminal comprising:

first and second plates for pinching the covered wire; and engaging portions provided on the first plate capable of being engaged with the second plate, the covered wire being pinched between the plates so that the covered wire is held when the engaging portion is engaged with the second plate.

According to the above structure, the covering portion is melted and removed by ultrasonic vibration so that the exposed cores are pinched between the first and the second plates. By applying a pressure at the same time, the engaging portion of the first plate is engaged with the second plate. As a result, the cores are held between the plates, thereby preventing slippage of the cores from the terminal and further the cores being conductively connected to both the plates. Therefore, the cores are firmly fixed at the terminal. Further, because the cores are in contact with both the plates, a sufficient contacting area is secured therebetween. Consequently, the electrical connecting reliability is improved.

According to a second aspect of the present invention, there is provided a terminal according to the first aspect wherein an end of the first plate is connected to an end of the second plate.

In the above structure, because the first and the second plates are integrally formed, the handling performance of the terminal is improved.

According to a third aspect of the invention, there is provided a terminal according to the first aspect wherein the engaging portion is a pair of engaging pawls provided on both sides of the covered wire to be pinched between the plates.

In this structure, because the engaging pawls are located on both sides of the covered wire, the covered wire to be pinched between the plates is prevented from slipping therefrom, so that the covered wire is held securely between both the plates.

According to a fourth aspect of the present invention, there is provided a connection structure between a terminal and wire, comprising:

a first resin part having a groove portion;

a second resin part having a protrusion to be inserted into the groove portion;

a covered wire having cores and a covering portion for covering the cores; and a terminal which is capable of being accommodated in the groove portion, the terminal including first and second plates for pinching the covered wire and an engaging portion of the first plate capable of being engaged with the second plate, the covered wire being pinched and held between the plates when the engaging portion is engaged with the second plate, the terminal and the covered wire being pinched between the protrusion and the groove portion when the protrusion is inserted into the groove portion with the covered wire being inserted between plates of the terminal accommodated in the groove portion;

the covering portion being melted and removed by applying ultrasonic vibration to the terminal and the covered wire pinched between the protrusion and the groove portion while a pressure is applied thereto, so that the engaging portion is engaged with the second plate and the cores are pinched and held between the plates.

According to the above structure, the covering portion of the covered wire is melted and removed by applying ultrasonic vibration so that the cores are exposed. Further, because the engaging portion is engaged with the second plate by applying a pressure, the cores are pinched and held between the plates securely. In this condition, both of the plates are in contact with the cores thereby securing a sufficient contact area and the connecting reliability being improved. Further, the plates are prevented by the engaging portion from being deviated in opposite directions, so that the cores are prevented from being loose from the plates. Therefore, even if the resin parts shrink due to a change of the temperature, the contact between the plates and the cores is never lost, so that a stable contacting condition therebetween is maintained.

DESCRIPTION OF THE PREFERRED EMBODIMENTS

Hereinafter, the embodiment of the present invention will be described with reference to the accompanying drawings.

Figure 1A:
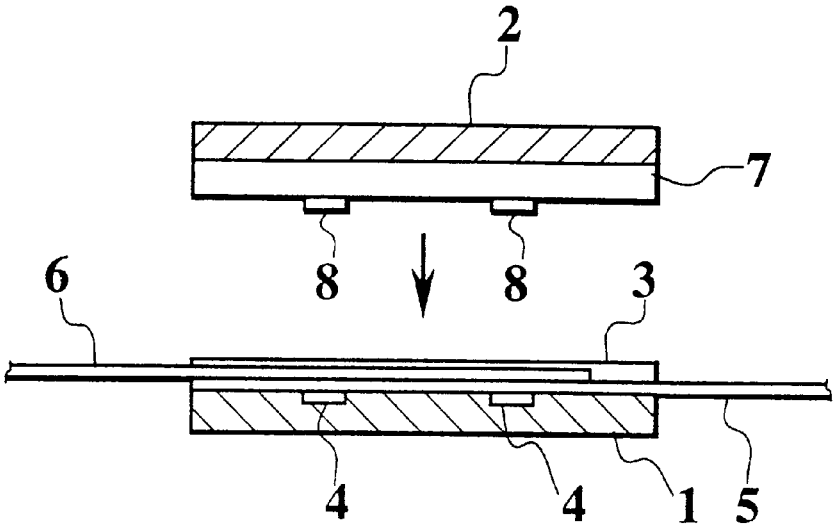
FIG.1A PRIOR ART
FIG. 1A is a sectional view of a conventional connection structure.
Figure 1B:
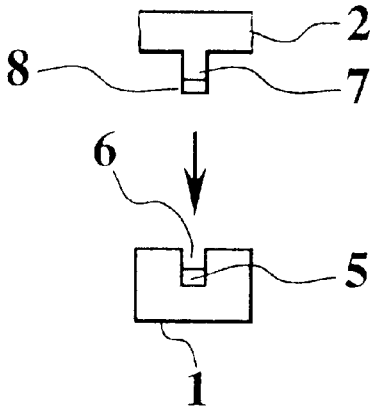
FIG.1B PRIOR ART
FIG. 1B is a front view of the conventional connection structure.
Figure 2:
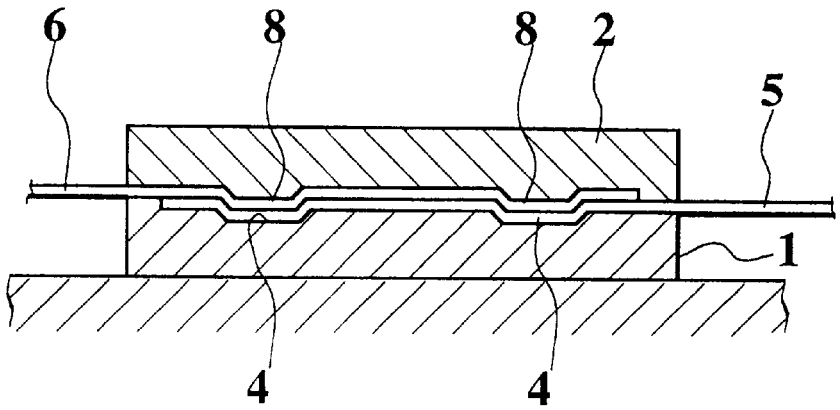
FIG.2 PRIOR ART
FIG. 2 is a sectional view of the conventional connection structure.
Figure 3:
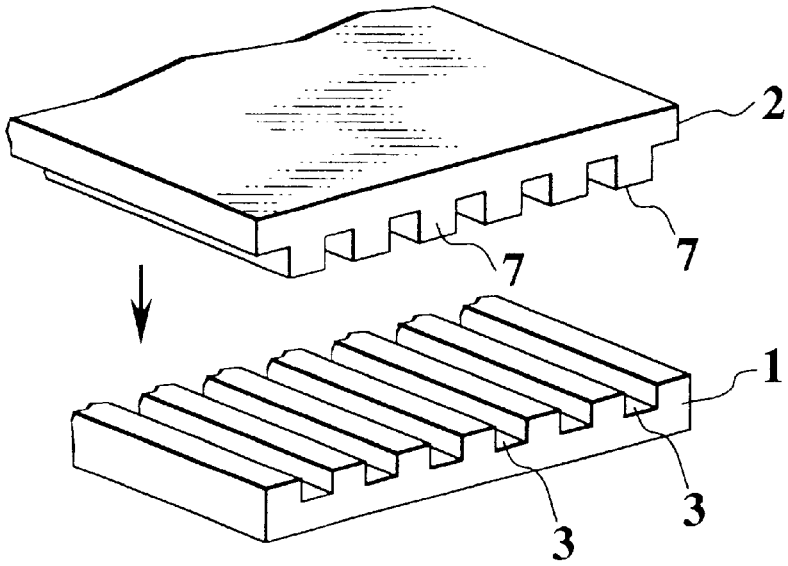
FIG.3 PRIOR ART
FIG. 3 is an exploded perspective view of a conventional structure for multiple-pole connection.
Figure 4:
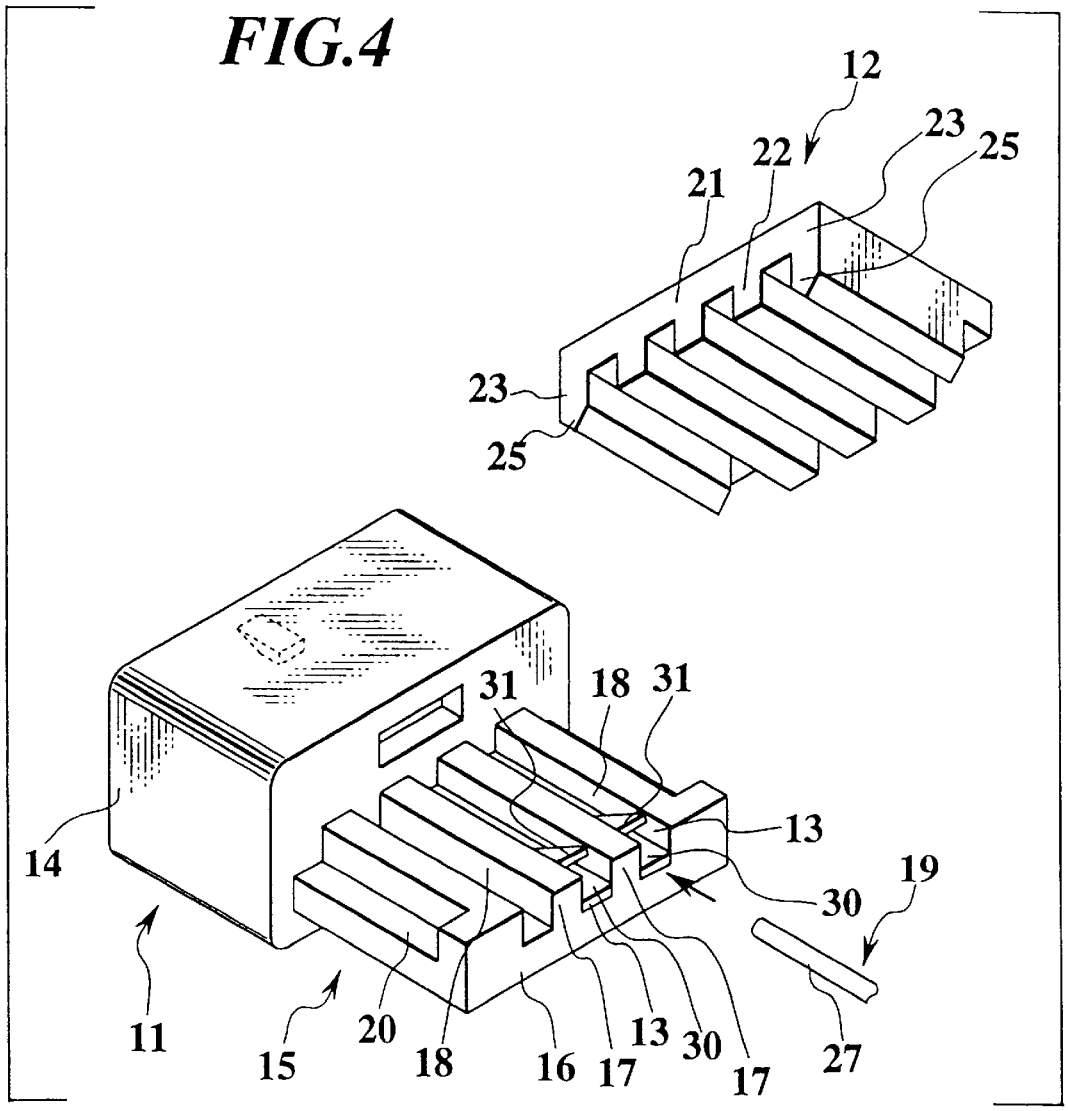
FIG. 4 is an exploded perspective view of an embodiment of the present invention.
Figure 5:
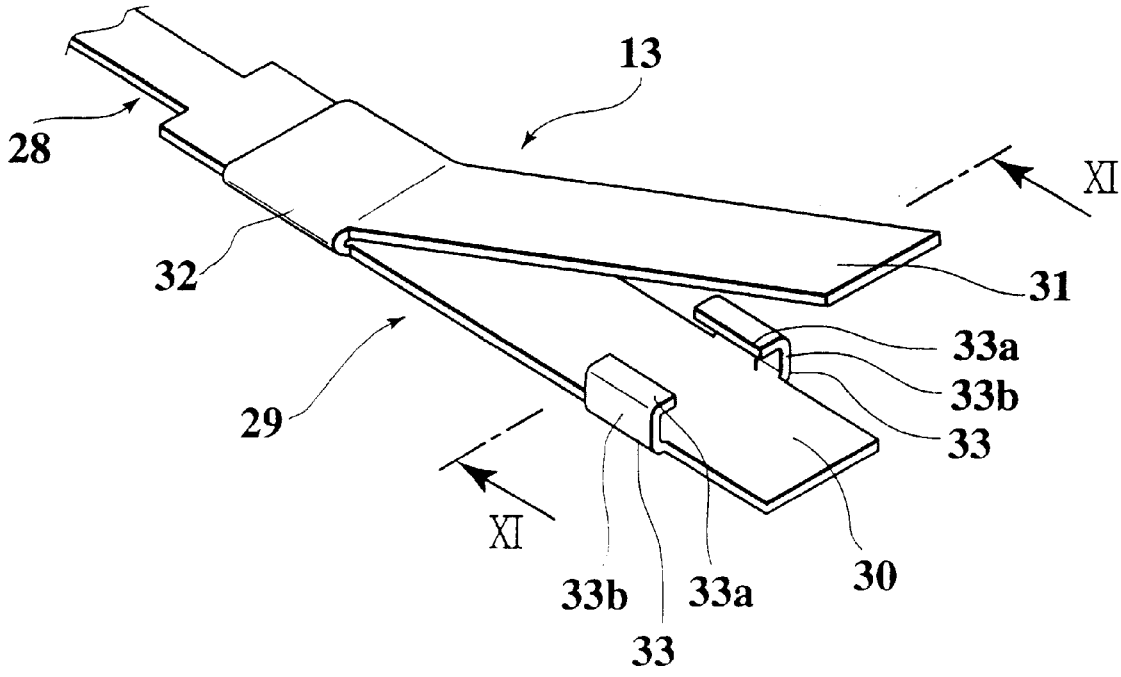
FIG. 5 is a perspective view of a terminal.
Figure 6:
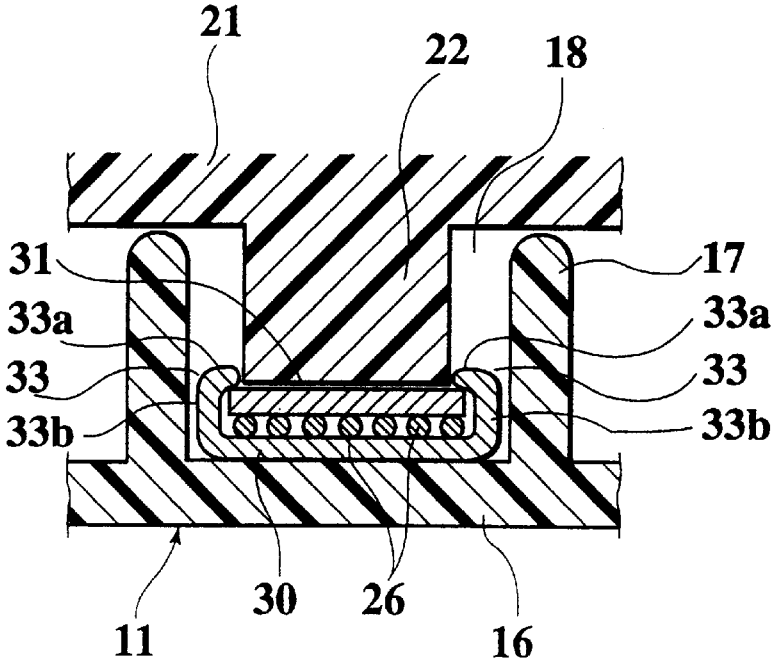
FIG. 6 is a sectional view showing a connecting condition, taken along the lines XI—XI of FIG. 5.

FIG. 4 is an exploded perspective view of an entire body of an embodiment of the present invention. FIG. 5 is a perspective view of a terminal and FIG. 6 is a sectional view of a connection structure corresponding to the line XI—XI of FIG. 5.

As shown in FIG. 4, the structure of the present embodiment comprises a first resin member 11, a second resin member 12 and a terminal 13 made of conductive metal.

The present embodiment is a case in which the present invention is applied to a connector. The first resin member 11 corresponds to a connector housing and the second resin member 12 corresponds to a cover.

The connector housing 11 comprises a hood portion 14 which is joined with and connected to a mating connector (not shown) and a wire introduction portion 15 disposed integrally on a side of the hood portion 14.

In the wire introduction portion 15, a bottom wall portion 16 extends from the hood portion 14. A plurality of partition portions 17 are projected in parallel from a top face of the bottom wall portion 16. A plurality of groove portions 18 are provided as portions surrounded by the partition portions 17. Each of the groove portions has a rectangular section and a top of the groove portion is open. Each of the terminals 13 accommodated in each of the groove portions 18 is connected to a covered wire 19. Outside the partition portions of the bottom wall portion are provided fusing portions 20 on which the cover is to be fused.

The cover 12 comprises a closed plate portion 21, a plurality of protrusions 22 which are projected from the closed plate portion 21 so as to oppose the wire introduction portion 15 and side wall portions 23 provided outside the protrusions 22.

The protrusion 22 has the same rectangular section as the groove portion 18 of the wire introduction portion 15. Each of the protrusions 22 is formed so as to oppose each of the groove portions 18. The protrusion 22 is formed in a slightly smaller size than the groove portion 18. When the cover 12 is mounted on the wire introduction portion 15, each of the protrusions 22 is inserted into each of the groove portions 18. The protrusion 22 inserted into the groove portion presses the terminal introduced in the groove portion 18 and the covered wire 19 inserted in the terminal 13.

The side wall portions 23 of the cover 12 oppose the fusing portions 20 of the wire introduction portion 15. By mounting the cover 12 on the wire introduction portion 15, the side wall portions come into contact with the fusing portions 20. A sharp edge fusing portion 25 is formed at a tip of the side wall portion 23. That fusing portion is fused with the fusing portion 20 of the wire introduction portion 15.

Preferably, the connector housing 11 and cover 12 are formed of acrylic resin, ABS (acrylonitrile-butadiene-styrene copolymer) resin, PC (polycarbonate) resin, PVC (polyvinyl chloride) resin, polyethylene, olefin resin such as polypropylene and the like, PEI (polyetherimide), PBT (polyethylene terephtalate), ABS/vinyl chloride alloy, acrylic/vinyl chloride alloy, polyester elastomer and block copolymer of PBT and polyether.

The covered wire 19 comprises a plurality of cores 26 (see FIG. 6) and covering portion 27 (see FIG. 4) made of insulating resin such as vinyl chloride or the like for covering the cores 26.

As shown in FIG. 5, the terminal 13 is formed of conductive metal. The terminal 13 includes a flat contacting portion 28 and a wire connecting portion 29 disposed continuously at a proximal end of the contacting portion 28. A front end of the contacting portion 28 is inserted through the hood portion 14 of the connector housing 11 so that it is electrically connected to a terminal of a mating connector engaged with the hood portion 14.

The wire connecting portion 29 of the terminal 13 includes a lower plate 30 formed integrally with the contacting portion 28 and an upper plate 31 rising from the lower plate 30. At an end of the upper plate on the side of the contacting portion 28 is provided an joint portion 32. The upper plate 31 and lower plate 30 are formed integrally through the joint portion 32. The upper plate 31 rises from the lower plate 30 such that it is slanted toward obliquely upward. As a result, if a pressure is applied to the upper plate 31, the upper plate 31 is turned toward the lower plate 30 so that it is overlaid with the lower plate 30. By coupling the upper plate 31 with lower plate 30 via the joint portion 32, the lower plate 30 and upper plate 31 are joined with each other so that they are not separated. Thus, the handling performance is raised.

A pair of engaging pawls 33 are provided integrally on both sides of the lower plate 30 in the length direction. The engaging pawls 33 rise upward from both sides of the lower plate 30. A top end of the engaging pawl 33 is formed as a hook portion 33*a* which is bent inward so as to engage with the upper plate 31.

A distance between a bottom end of the hook portion 33*a* and a top face of the lower plate 30 or a height of a rising portion 33*b* of the engaging pawl 33 is set so as to be slightly smaller than a diameter of the core 26 of the covered wire 19 plus a thickness of the upper plate 31. Thus, if the hook portion 33*a* is engaged with the upper plate 31, the upper plate 31 and lower plate 30 pinch the cores 26 with a pressure being applied thereto, so that the cores 26 are firmly fixed. Further, because the upper plate 31 and lower plate 30 come into contact with the cores 26 from both up and down, a large contacting area is secured so that contact resistance is reduced thereby ensuring a stable connecting state.

The engaging pawls 33 are disposed on both sides of the lower plate 30 so that they are located on both sides of the covered wire 19 inserted between the lower plate 30 and upper plate 31. Thus the covered wire 19 is never deviated laterally from its insertion position. Therefore a slippage of the covered wire 19 due to that lateral deviation is prevented so that the covered wire 19 is held in a stable condition.

Next, an assembly procedure of the present embodiment will be described.

As shown in FIG. 4, the terminal 13 is introduced into each of the groove portions 18 of the connector housing 11 and the front end of the contacting portion 28 is inserted through the hood portion 14. At this time, the upper plate 31 rises obliquely from the lower plate 30. With this condition, the covered wire 19 is inserted between the lower plate 30 and upper plate 31.

Then, the cover 12 is mounted on the wire introduction portion 15 of the connector housing 11. At this time, each of the protrusions 22 of the cover 12 is aligned with each of the groove portions 18 and inserted into the groove portion 18. Next, the upper plate 31 of the terminal 13 is pressed down so that the covered wire 19 is pinched by the upper plate 31 and lower plate 30.

Next, a horn (not shown) is brought into contact with the cover 12 and ultrasonic vibration is applied thereto while a pressure is being applied. By this ultrasonic vibration, the covering portion 27 of the covered wire 19 is heated, melted and removed so that the cores 26 are exposed. Because the exposed cores 26 are supplied with a pressure through the upper plate 31, they are arranged on a surface of the lower plate 30. At the same time, the upper plate 31 is pressed down, and therefore as shown in FIG. 6, the upper plate 31 is engaged with the hook portions 33*a* of the engaging pawls 33 rising from the lower plate 30. By this engagement, the upper plate 31 and lower plate 30 make contact with the cores 26 so that they are conductively connected to the cores 26 and at the same time, they hold the cores 26 from up and down.

On the other hand, a joint between the connector housing 11 and cover 12 is carried out by making the respective fusing portions 20, 25 into contact with each other and fusing both the fusing portions 20, 25 by applying ultrasonic vibration while a pressure is also applied.

In the above embodiment, by the engagement between the engaging pawls 33 and lower plate 30, the upper plate 31 and lower plate 30 are in contact with the cores 26 from up and down. Thus, a large contacting area is secured between the terminal 13 and cores 26 so that contact resistance therebetween is reduced, thereby improving contact reliability. Further, the lower plate 30 and upper plate 31 hold the cores 26 firmly from up and down. Thus, even if the protrusions 22 shrink due to a change of the temperature or like reason so that their load is reduced, the contact condition between the cores 26 and terminal 13 is never made loose, and even if the terminal 13 is deviated during the engagement of the connector, it never slips from the contact condition with the cores 26 thereby maintaining a stable conductive contact.

Figure 7:
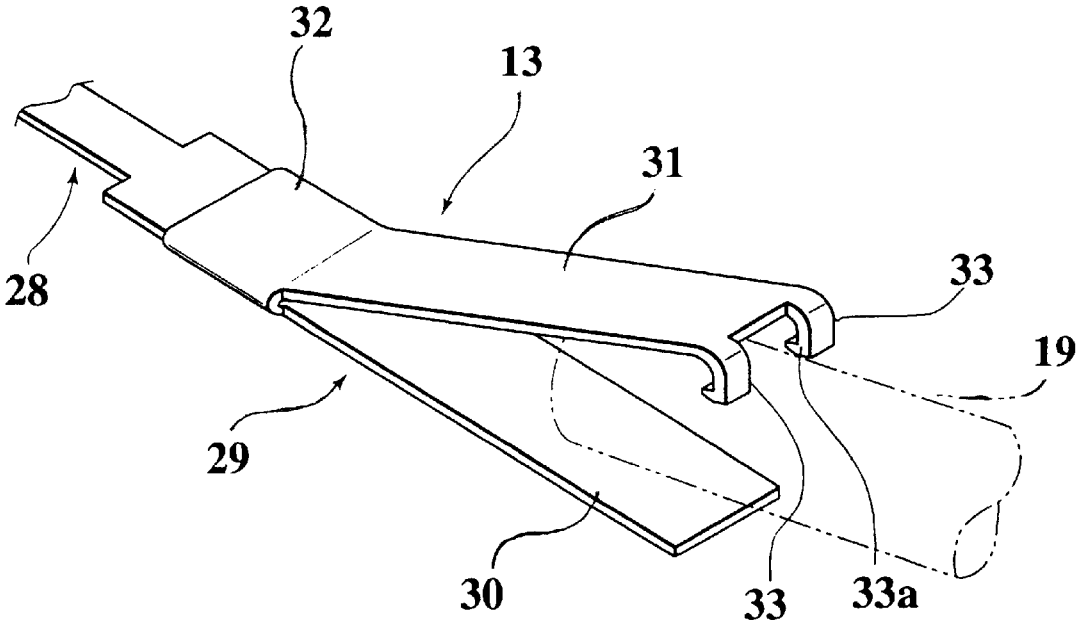
FIG. 7 is a perspective view of another embodiment of the terminal.

FIG. 7 shows another embodiment of the terminal 13 according to the present invention. In the present embodiment, the engaging pawls 33 are provided on the upper plate 31. The engaging pawls 33 are bent downward from an end of the upper plate 31 and when the upper plate 31 is pressed down, are engaged with an end of the lower plate 30. In this case also, the length of the engaging pawl 33 is so determined that the lower plate 30 and upper plate 31 pinch the cores 26 with a pressure being applied thereto. A pair of the engaging pawls 33 are disposed so as to be located at both sides of the covered wire 19 thereby preventing the covered wire 19 from being slipped out.

In the present invention, it is permissible to dispose the engaging pawls 33 on both the lower plate 30 and upper plate 31 or provide one or more pairs thereof.

What is claimed is:

1. A terminal coming in a conductive contact with a core of a covered wire, the covered wire having the core and a covering portion made of resin for covering the core, the covering portion being melted and removed when the covered wire is subjected to ultrasonic vibration while the covered wire is pressed against the terminal, so that the terminal is in a conductive contact with the core, the terminal comprising:

first and second plates for pinching the covered wire; and engaging portions provided on the first plate capable of being engaged with the second plate, the covered wire being pinched between the plates so that the covered wire is held when the engaging portion is engaged with the second plate.

2. A terminal according to claim 1 wherein an end of the first plate is connected to an end of the second plate.

3. A terminal according to claim 1 wherein the engaging portion is a pair of engaging pawls provided on both sides of the covered wire to be pinched between the plates.

4. A terminal according to claim 3 wherein the engaging pawls are provided at an end of the first plate.

5. A terminal according to claim 1 wherein the terminal is formed of a single metal plate.

6. A connection structure between a terminal and a wire, comprising:

a first resin part having a groove portion;

a second resin part having a protrusion to be inserted into the groove portion;

a covered wire having a core and a covering portion for covering the core; and a terminal capable of being accommodated in the groove portion, the terminal including first and second plates for pinching the covered wire and an engaging portion of the first plate capable of being engaged with the second plate, the covered wire being pinched and held between the plates when the engaging portion is engaged with the second plate, the terminal and covered wire being pinched between the protrusion and groove portion when the protrusion is inserted into the groove portion with the covered wire being inserted between plates of the terminal accommodated in the groove portion, the covering portion being melted and removed by applying ultrasonic vibration to the terminal and the covered wire pinched between the protrusion and the groove portion while a pressure is applied thereto, so that the engaging portion is engaged with the second plate and the core is pinched and held between the plates.

7. A connecting method for connecting a terminal and a covered wire, the covered wire has a core and a covering portion made of resin for covering the core, the terminal being accommodated in a groove portion of a first resin part, and a protrusion of a second resin part being inserted into the groove portion, the terminal including first and second plates for pinching the covered wire and an engaging portion of the first plate capable of being engaged with the second plate, and the covered wire being pinched and held between the plates when the engaging portion is engaged with the second plate, the connecting method comprising the steps of:

inserting the protrusion into the groove portion with the covered wire being inserted between the plates of the terminal accommodated in the groove portion, so that the terminal and the covered wire are pinched between the protrusion and the groove portion; and applying ultrasonic vibration while a pressure is being applied to the terminal and the covered wire pinched between the protrusion and the groove portion, so that the covering portion is melted and removed, and the engaging portion is engaged with the second plate so that the core is pinched and held between the plates.

* * * * *

UNITED STATES PATENT AND TRADEMARK OFFICE

CERTIFICATE OF CORRECTION

PATENT NO. : 6,099,366
DATED : August 8, 2000
INVENTOR(S) : Akira Shinchi

It is certified that error appears in the above-identified patent and that said Letters Patent is hereby corrected as shown below:

Claim 1, column 6,
Line 41, "engaging portions" should read -- engaging portion --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*